US005768914A

United States Patent [19]

Xu et al.

[11] Patent Number: 5,768,914

[45] Date of Patent: Jun. 23, 1998

[54] PROCESS TO PRODUCE OXYGEN AND ARGON USING DIVIDED ARGON COLUMN

[75] Inventors: Jianguo Xu, Fogelsville; Jeffrey A. Hopkins, Whitehall, both of Pa.

[73] Assignee: Air Products and Chemicals, Inc., Allentown, Pa.

[21] Appl. No.: 901,538

[22] Filed: Jul. 28, 1997

[51] Int. Cl.[6] ..... F25J 3/04

[52] U.S. Cl. ..... 62/648; 62/924

[58] Field of Search ..... 62/648, 924

[56] References Cited

U.S. PATENT DOCUMENTS

| | | | |
|---|---|---|---|
| 5,019,145 | 5/1991 | Rohde et al. | 62/924 |
| 5,049,173 | 9/1991 | Cormier, Sr. et al. | 62/924 |
| 5,572,874 | 11/1996 | Rathbone | 62/645 |

FOREIGN PATENT DOCUMENTS

714000A2 5/1996 European Pat. Off. .

*Primary Examiner*—Ronald C. Capossela
*Attorney, Agent, or Firm*—Robert J. Wolff

[57] ABSTRACT

A process is set forth for the cryogenic distillation of an air feed to produce oxygen and argon and is particularly applicable where high purity oxygen and ultra-high purity argon are required and where only moderate argon recovery is required. A key to the present invention is that the argon column is divided into a lower section and an upper section and the impure argon overhead from the lower section is split into three portions. The first portion is further distilled to the desired purity in the top section, the second portion is condensed and returned as reflux to the lower section, and the third portion is removed as an impure argon stream. Such a scheme allows one to reduce the diameter of the argon column's top section, thereby providing a capital cost savings.

5 Claims, 2 Drawing Sheets

PROCESS TO PRODUCE OXYGEN AND ARGON USING DIVIDED ARGON COLUMN

BACKGROUND OF THE INVENTION

The present invention relates to a process for the cryogenic distillation of an air feed to produce oxygen and argon and is particularly applicable where high purity oxygen and ultra-high purity argon are required and where only moderate argon recovery is required. (As used herein, the term "air feed" generally means atmospheric air but also includes any gas mixture containing at least nitrogen, oxygen and argon.)

In the typical process for the cryogenic distillation of an air feed to produce oxygen and argon, high argon recovery is necessary to achieve high oxygen recovery. This means the argon column diameter must be large enough throughout its length to produce that amount of argon. When the desired argon recovery is moderate, the excess amount of argon is discarded which constitutes a waste. If the feed to the argon column is reduced in order to reduce the required argon column diameter, such that the argon recovery is moderate, the oxygen recovery will have to go down in order to keep the oxygen purity high. Therefore, the typical process does not have an economical option when the desired oxygen purity is high (generally greater than 99.5% oxygen) and the desired argon recovery is moderate (generally less the 40% recovery of the argon in the air feed).

The present invention provides such an economical option by dividing the argon column into a lower section and an upper section and splitting the impure argon overhead from the lower section into three portions. The first portion is further distilled to the desired purity in the top section, the second portion is condensed and returned as reflux to the lower section, and the third portion is removed as an impure argon stream. Such a scheme allows one to reduce the diameter of the argon column's top section, thereby providing a capital cost savings.

It is well known in the art of distillation to simply withdraw an impure stream from an intermediate location of the column to yield a product stream with a lower purity from the overhead product. This technique is widely practiced in cryogenic air separation. For example, in the low pressure column of the conventional double column air separation system, it is a common practice to remove a waste nitrogen stream from an upper location in the low pressure column in order to reduce the vapor flow and the liquid/vapor ratio in the section above the waste nitrogen removal location. This can significantly reduce the diameter of the top section of the low pressure column, and at the same time reduce the number of stages needed to achieve the purity of the overhead nitrogen product.

This same "intermediate removal" technique can be applied to the argon column. See for example published European patent application EP 0 714 005 A2 which teaches the removal of an impure argon stream from an intermediate location in the argon column. The benefit of applying this technique to the argon column vis-a-vis the low pressure column is relatively small however. This is because oxygen/argon mixtures are much more difficult to separate than oxygen/nitrogen mixtures due to the fact that the boiling points of pure oxygen and pure argon are much closer than the boiling points of pure oxygen and pure nitrogen. Consequently, the argon column requires a very high reflux ratio (in addition to a large number of theoretical stages) and thus removing an impure argon stream from an intermediate location in the argon column has a very small effect on the total vapor and liquid traffic in the argon column and a corresponding very small effect on the diameter of the argon column above the removal location.

The present invention recognizes this shortcoming of applying only the "intermediate removal" technique to the argon column and applies a more comprehensive technique to enable a reduction in the diameter of the argon column above the removal location for situations where only moderate argon recovery is required. Namely, as noted above, the present invention also incorporates a reboiler/condenser in order to condense a portion of the removed impure argon. The condensed impure argon is then used as reflux for that portion of the argon column below the removal location.

BRIEF SUMMARY OF THE INVENTION

The present invention is a process for the cryogenic distillation of an air feed to produce oxygen and argon and is particularly applicable where high purity oxygen and ultra-high purity argon are required and where only moderate argon recovery is required. A key to the present invention is that the argon column is divided into a lower section and an upper section and the impure argon overhead from the lower section is split into three portions. The first portion is further distilled to the desired purity in the top section, the second portion is condensed and returned as reflux to the lower section, and the third portion is removed as an impure argon stream. Such a scheme allows one to reduce the diameter of the argon column's top section, thereby providing a capital cost savings.

DETAILED DESCRIPTION OF THE INVENTION

The present invention is a process for the cryogenic distillation of an air feed to produce oxygen and argon and is particularly applicable where high purity oxygen (generally greater than 99.5% oxygen) and ultra-high purity argon (generally less than 10 ppm oxygen) are required and where only moderate argon recovery (generally less the 40% recovery of the argon in the air feed) is required.

Figure 1:
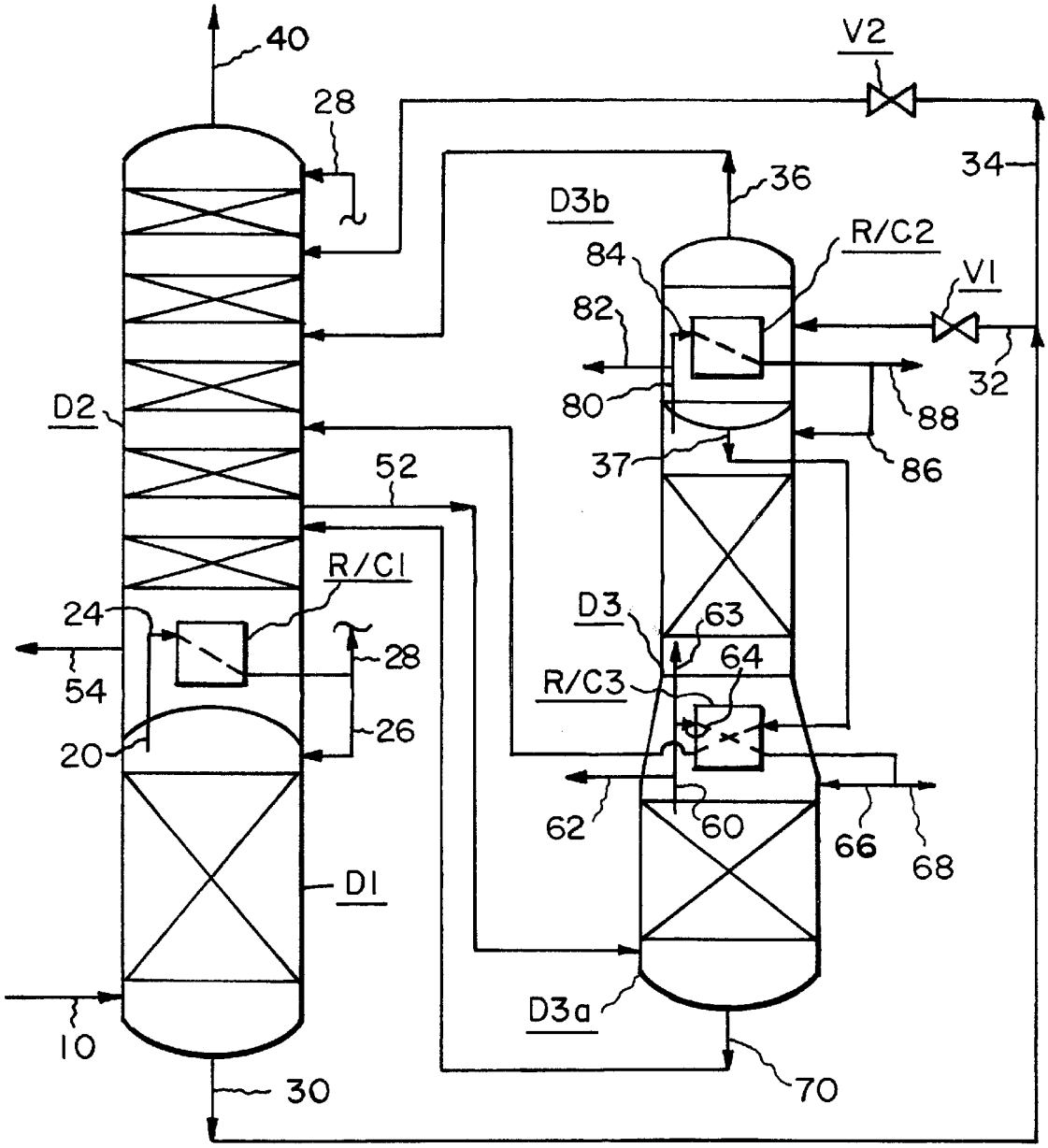
FIG. 1 is a schematic drawing of one embodiment of the present invention.
Figure 2:
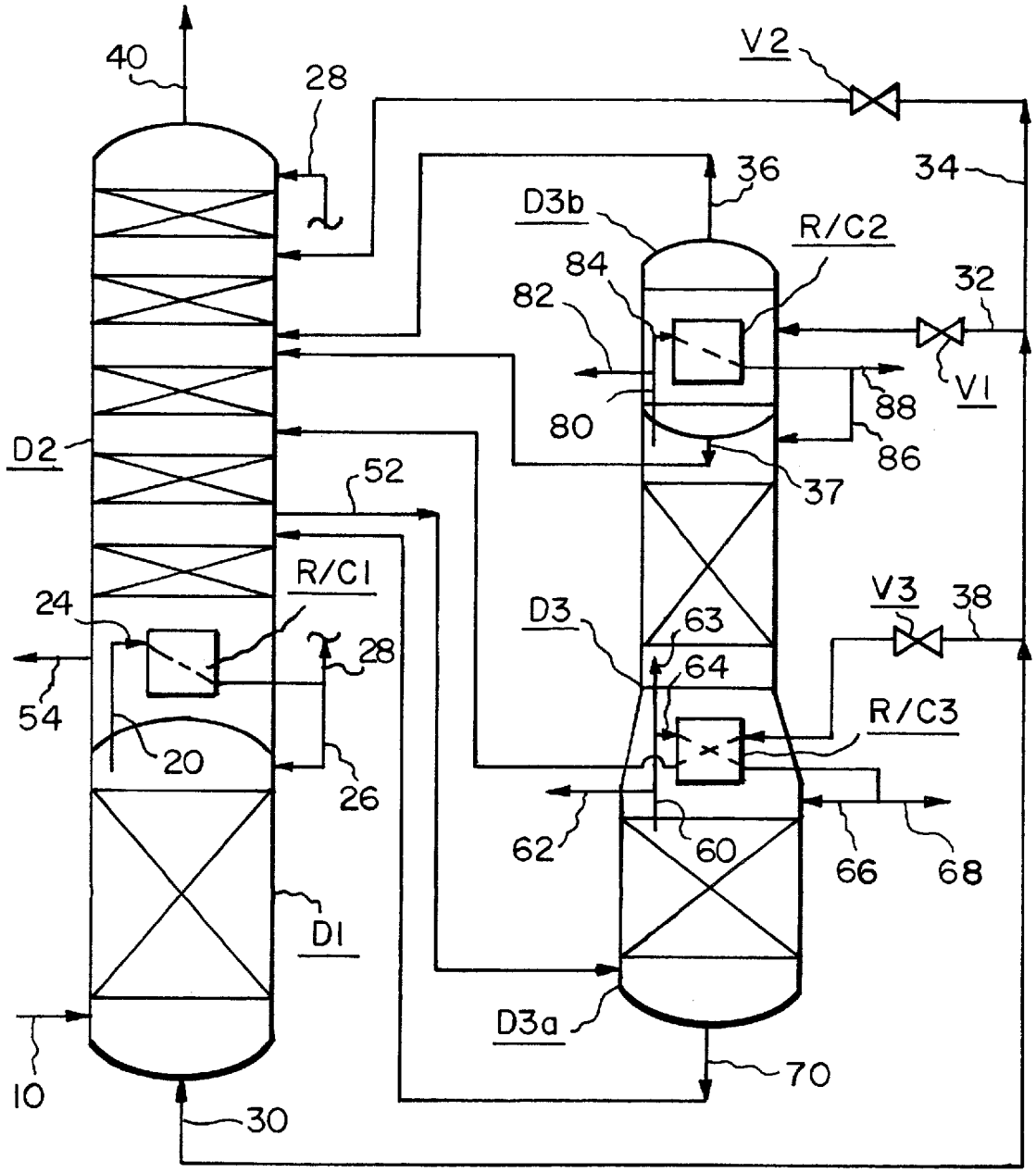
FIG. 2 is a schematic drawing of a second embodiment of the present invention.

With reference to FIGS. 1 and 2, the process of the present invention uses a distillation column system comprising a high pressure column [D1], a low pressure column [D2] and an argon column [D3] having a lower section [D3a] and an upper section [D3b]. With further reference to FIGS. 1 and 2, the process of the present invention comprises:

(a) feeding at least a first portion of the air feed [10] to the bottom of the high pressure column;

(b) collecting a nitrogen-enriched overhead [20] at the top of the high pressure column, condensing at least a first portion [24] thereof in a first reboiler/condenser [R/C 1] located in the bottom of the low pressure column to produce a nitrogen-enriched liquid and feeding at least a first part [26] of the nitrogen-enriched liquid as reflux to an upper location in the high pressure column;

(c) removing a crude liquid oxygen stream [30] from the bottom of the high pressure column, reducing the pressure of a first portion [32] thereof across valve V1, partially vaporizing said first portion in a second reboiler/condenser [R/C 2] located at the top of the argon column's upper section into a vaporized part [36] and a remaining liquid part [37], and feeding the vaporized part to an upper intermediate location in the low pressure column;

(d) removing a nitrogen rich overhead [40] from the top of the low pressure column as a secondary product stream;

(e) collecting an oxygen rich liquid at the bottom of the low pressure column, vaporizing at least a first portion thereof in the first reboiler/condenser [R/Cl] to produce an oxygen rich vapor and removing a portion of the oxygen rich liquid and/or oxygen rich vapor as the oxygen product [54];

(f) removing a vapor stream [52] enriched in argon from a lower intermediate location in the low pressure column and feeding it to the bottom of the argon column's lower section;

(g) collecting an argon-enriched (generally containing between 0.1% and 5.0% oxygen) overhead [60] from the top of the argon column's lower section, feeding a first portion [63] to the bottom of the argon column's upper section, condensing a second portion [64] thereof in a third reboiler/condenser [R/C 3] located between the argon column's upper and lower sections to produce an argon-enriched liquid, feeding at least a first part [66] of the argon-enriched liquid as reflux to an upper location in the argon column's lower section and removing a third portion [62] of the argon-enriched overhead and/or a second part [68] of the argon-enriched liquid as an impure argon stream, (h) collecting an argon rich overhead [80] from the top of the argon column's upper section, condensing at least a first portion [84] thereof in the second reboiler/condenser [R/C2] to produce an argon rich liquid, feeding at least a first part [86] of the argon rich liquid as reflux to an upper location in the argon column's upper section and removing a second portion [82] of the argon rich overhead and/or a second part [98] of the argon rich liquid as the argon product; and (i) removing a liquid stream [70] from the bottom of the argon column's lower section and feeding it to a lower intermediate location in the low pressure column.

Also shown in FIGS. 1 and 2 are the following steps which are preferably performed in the present invention:

(j) reducing the pressure of a second portion [34] of the crude liquid oxygen stream [30] from the bottom of the high pressure column across valve V2, and feeding said second portion to an upper location in the low pressure column; and (k) feeding a second part [28] of the nitrogen-enriched liquid from step (b) as reflux to an upper location in the low pressure column.

In one embodiment of the present invention, and with further reference to FIG. 1, the process further comprises:

(I) at least partially vaporizing the remaining liquid part [37] of the second portion of the crude liquid oxygen bottoms from step (c) in the third reboiler/condenser [R/C 3] and feeding the resulting at least partially vaporized stream to an intermediate location in the low pressure column.

In a second embodiment of the present invention, and with further reference to FIG. 2, the process further comprises:

(l) reducing the pressure of a third portion [38] of the crude liquid oxygen stream across valve V3, at least partially vaporizing said third portion in the third reboiler/condenser [R/C 3] and feeding the resulting at least partially vaporized stream to an intermediate location in the low pressure column.

(m) feeding the remaining liquid part [37] of the second portion of the crude liquid oxygen bottoms from step (c) to an upper intermediate location in the low pressure column.

It should be noted that the argon product may need to be sent to a nitrogen removal unit, depending on the amount of nitrogen that may be tolerated in the argon product.

It should further be noted that although the argon column's bottom section [D3a], the argon column's top section [D3b], the second reboiler/condenser [R/C2] and the third reboiler/condenser [R/C3] are shown as one vertical piece in FIGS. 1 and 2, they may in fact each be separate vessels connected in a different arrangement with the appropriate connecting piping. For example, the argon column's top section can be adjacent to or even underneath the argon column's bottom section. Furthermore, one section of the argon column may be packed or partly packed while the other section is trayed.

It should still further be noted that the low pressure column's distillation section shown in FIGS. 1 and 2 between feed streams 36 and 37 is optional. Also, depending on the nitrogen purity requirement, if any, for the nitrogen rich overhead [40] which is removed from the top of the low pressure column, a nitrogen rich waste stream can be removed from an upper location in the low pressure column in order to increase the nitrogen purity of the overhead as is well known in the art.

The skilled practitioner will appreciate that the following ordinary features of an air separation process, which have been omitted from FIGS. 1 and 2 for simplicity, can easily be incorporated by one skilled in the art.

(1) Main air compressor, front end clean-up system and main heat exchanger.

Prior to feeding the air feed to the distillation column system, the air feed is compressed in a main air compressor, cleaned of impurities which will freeze out at cryogenic temperatures (such as water and carbon dioxide) and/or other undesirable impurities (such as carbon monoxide and hydrogen) in a front end clean-up system and cooled to a temperature near its dew point in a main heat exchanger against warming product streams.

(2) Refrigeration generating expander scheme.

Especially where a large quantity of liquid product is desired, it may be necessary to generate additional refrigeration in the process to complete the heat balance. This is typically accomplished by expanding at least a portion of the air feed and/or gaseous waste stream(s) and/or gaseous product stream(s). Where air expansion is employed, the expanded air is subsequently fed to an appropriate location in the distillation column system, while in the other cases, the expanded gas is subsequently warmed in the main heat exchanger against the incoming air feed. Opportunities may also exist to link the expander with a compressor in the process such that the work produced by the expander is used to drive the compressor (i.e. a compander arrangement).

(3) Subcooling heat exchangers.

Prior to reducing the pressure of the liquid streams from the high pressure column and feeding them to the low pressure column/argon column, such streams may be subcooled in one or more subcooling heat exchangers against warming product streams from the low pressure column/argon column. This type of heat integration increases the overall thermodynamic efficiency of the process.

We claim:

1. A process for the cryogenic distillation of an air feed to produce an oxygen product and an argon product using a distillation column system comprising a high pressure column, a low pressure column and an argon column having a lower section and an upper section, said process comprising:

(a) feeding at least a first portion of the air feed to the high pressure column;

(b) collecting a nitrogen-enriched overhead at the top of the high pressure column, condensing at least a first portion thereof in a first reboiler/condenser to produce a nitrogen-enriched liquid and feeding at least a first part of the nitrogen-enriched liquid as reflux to an upper location in the high pressure column;

(c) removing a crude liquid oxygen stream from the bottom of the high pressure column, reducing the pressure of at least a first portion thereof, partially vaporizing said first portion in a second reboiler/condenser into a vaporized part and a remaining liquid part, and feeding the vaporized part to the low pressure column;

(d) removing a nitrogen rich overhead from the top of the low pressure column as a secondary product stream;

(e) collecting an oxygen rich liquid at the bottom of the low pressure column, vaporizing at least a first portion thereof in the first reboiler/condenser to produce an oxygen rich vapor and removing a portion of the oxygen rich liquid and/or oxygen rich vapor as said oxygen product;

(f) removing a vapor stream enriched in argon from the low pressure column and feeding it to the bottom of the argon column's lower section;

(g) collecting an argon-enriched overhead from the top of the argon column's lower section, feeding a first portion thereof to the bottom of the argon column's upper section, condensing a second portion thereof in a third reboiler/condenser to produce an argon-enriched liquid, feeding at least a first part of the argon-enriched liquid as reflux to an upper location in the argon column's lower section and removing a third portion of the argon-enriched overhead and/or a second part of the argon-enriched liquid as an impure argon stream;

(h) collecting an argon rich overhead from the top of the argon column's upper section, condensing at least a first portion thereof in the second reboiler/condenser to produce an argon rich liquid, feeding at least a first part of the argon rich liquid as said argon product; and (i) removing a liquid stream from the bottom of the argon column's lower section and feeding it to the low pressure column.

2. The process of claim 1 wherein said process further comprises:

(j) reducing the pressure of a second portion of the crude liquid oxygen stream from the bottom of the high pressure column and feeding said second portion to the low pressure column; and (k) feeding a second part of the nitrogen-enriched liquid from step (b) as reflux to an upper location in the low pressure column.

3. The process of claim 2 wherein said process further comprises:

(l) at least partially vaporizing the remaining liquid part of the second portion of the crude liquid oxygen bottoms from step (c) in the third reboiler/condenser and feeding the resulting at least partially vaporized stream to the low pressure column.

4. The process of claim 2 wherein said process further comprises:

(l) reducing the pressure of a third portion of the crude liquid oxygen stream, at least partially vapporizing said third portion in the third reboiler/condenser and feeding the resulting at least partially vaporized stream of the low pressure column; and (m) feeding the remaining liquid part of the second portion of the crude liquid oxygen bottoms from step (c) to the low pressure column.

5. The process of claim 1 wherein:

(I) the oxygen product removed in step (e) contains greater than 99.5% oxygen;

(II) the argon-enriched overhead collected from the top of the argon column's lower section in step (g) contains between 0.1% and 5.0% oxygen;

(III) the argon product removed in step (h) contains less than 10 ppm oxygen; and (IV)less than 40% of the argon contained in the air feed is recovered in the argon product.

* * * * *

UNITED STATES PATENT AND TRADEMARK OFFICE

CERTIFICATE OF CORRECTION

PATENT NO. : 5,768,914

DATED : Jun. 23, 1998

INVENTOR(S) : Jianguo, et al.

It is certified that error appears in the above-indentified patent and that said Letters Patent is hereby corrected as shown below:

In the Claims:

Column 5, line 40, Claim 1 (h), between "liquid" and "as" insert -- as reflux to an upper location in the argon column's upper section and removing a second portion of the argon rich overhead and/or a second part of the argon rich liquid --.

Signed and Sealed this

Third Day of November, 1998

*Attest:*

*Attesting Officer*

Bruce Lehman

BRUCE LEHMAN

*Commissioner of Patents and Trademarks*